US008431813B2

(12) United States Patent
Mori

(10) Patent No.: US 8,431,813 B2
(45) Date of Patent: Apr. 30, 2013

(54) PERCUSSION INSTRUMENT AND METHOD WITH COUPLING DEVICES

(75) Inventor: Yoshiaki Mori, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 254 days.

(21) Appl. No.: 12/693,203

(22) Filed: Jan. 25, 2010

(65) Prior Publication Data

US 2010/0307323 A1 Dec. 9, 2010

(30) Foreign Application Priority Data

Jun. 8, 2009 (JP) ..... 2009-137730

(51) Int. Cl.
*G10D 13/02* (2006.01)
*G10H 3/00* (2006.01)

(52) U.S. Cl.
USPC ..... 84/723; 84/411 R; 84/743

(58) Field of Classification Search ..... 84/723
See application file for complete search history.

(56) References Cited

U.S. PATENT DOCUMENTS

| | | | | |
|---|---|---|---|---|
| 4,519,289 | A | 5/1985 | Gauger | |
| 4,581,972 | A * | 4/1986 | Hoshino | 84/723 |
| 4,732,070 | A * | 3/1988 | Yamashita | 84/746 |
| 4,869,146 | A | 9/1989 | Bonsor | |
| 4,947,725 | A * | 8/1990 | Nomura | 84/723 |
| 5,293,000 | A | 3/1994 | Adinolfi | |
| 5,309,811 | A * | 5/1994 | Hoshino | 84/421 |
| 5,337,645 | A * | 8/1994 | Johnston | 84/421 |
| 5,977,464 | A * | 11/1999 | Bencomo, Jr. | 84/421 |
| 5,977,473 | A * | 11/1999 | Adinolfi | 84/723 |
| 6,417,432 | B1 | 7/2002 | Downing | |
| 6,576,829 | B1 | 6/2003 | Hart | |
| 6,982,376 | B2 * | 1/2006 | Wise | 84/600 |
| 7,256,342 | B2 * | 8/2007 | Hagiwara et al. | 84/726 |
| 8,173,886 | B2 * | 5/2012 | Hashimoto | 84/723 |
| 2004/0211310 | A1 | 10/2004 | Hagiwara et al. | |
| 2005/0223880 | A1 | 10/2005 | Yoshino et al. | |
| 2008/0168886 | A1 | 7/2008 | Neumayer et al. | |
| 2009/0000464 | A1 * | 1/2009 | Mishima | 84/724 |

FOREIGN PATENT DOCUMENTS

| | | |
|---|---|---|
| JP | S59-069794 | 4/1984 |
| JP | H03-111895 | 5/1991 |
| JP | H05-073694 | 10/1993 |
| JP | H07-008892 | 2/1995 |
| JP | 3055919 | 11/1998 |
| JP | 11-173876 A | 7/1999 |
| JP | 11-237877 A | 8/1999 |
| JP | 2008-186036 | 8/2008 |
| JP | 2009-137730 | 6/2009 |

OTHER PUBLICATIONS

English Machine translation for Japanese application No. JP H07-008892.

(Continued)

*Primary Examiner* — Christopher Uhlir
(74) *Attorney, Agent, or Firm* — Foley & Lardner LLP

(57) ABSTRACT

A percussion instrument may include a plurality of coupling device for operatively connecting a first hoop member, which may be configured to hold down a head arranged across a first end of a shell, with a second hoop member, which may be arranged on a second end of the shell. A sensor adjacent the head configured to detect vibration of the head may be operatively connected to the second hoop member.

31 Claims, 7 Drawing Sheets

OTHER PUBLICATIONS

English Machine translation for Japanese application No. JP H3111895.
English translation for Japanese patent application No. JP S59-069794.
Machine translation for Japanese patent application No. JP H05-073694.
Machine translation for Japanese patent application No. JP 2008-186036.
English Machine translation for Japanese application No. JP 3055919.
European Search Opinion and Extended European Search Report dated Jul. 27, 2010 for application No. 10160308.2-2225.
English Machine translation for Japanese application No. JP H07-008892, Feb. 7, 1995.
English Machine translation for Japanese application No. JP H3111895, May 13, 1991.
English Machine translation for Japanese application No. JP 3055919, Nov. 4, 1998.
English translation for Japanese patent application No. JP S59-069794, Apr. 20, 1984.
Machine translation for Japanese patent application No. JP H05-073694, Oct. 8, 1993.
Machine translation for Japanese patent application No. JP 2008-186036, Aug. 14, 2008.

* cited by examiner

PERCUSSION INSTRUMENT AND METHOD WITH COUPLING DEVICES

CROSS-REFERENCE TO RELATED PATENT APPLICATIONS

Japan Priority Application 2009-137730, filed Jun. 8, 2009 including the specification, drawings, claims and abstract, is incorporated herein by reference in its entirety.

BACKGROUND

1. Field of the Invention

Embodiments of the present invention generally relate to an electronic percussion instrument, and, in specific embodiments, to electronic percussion instrument having improved rigidity and/or weight properties.

2. Related Art

Various kinds of electronics drum exist today. Among these, are so-called electronic drums that simulate acoustic drums. Such a drum is furnished with a sensor for detecting a vibration caused from striking the drum. The sound source is controlled based on the detection signal of the sensor and a musical tone is generated based on the striking of the drum.

Japanese Laid-Open Patent Application Publication (Kokai) Number 2008-186036 discloses a drum having a head (striking surface head) attached to the opening section of the back surface side (the surface on the side that faces the performer) of the shell (the tubular member), which is a cylindrically shaped body, as the striking surface. In addition, the striking sensor (the striking surface sensor) that detects the vibration of the head is attached to the frame that has been fixed to the inside of the shell.

However, with such a drum, in order to have the vibrations at the time the head has been struck detected with certainty, it is necessary that the striking sensor be fixed solidly and the state of contact between the striking sensor and the head be constantly maintained. In other words, strong rigidity of the shell to which the frame is attached is required. Therefore, such shells present a problem in that only limited kinds of materials may be used to form the shell. In addition, such materials increase the cost and/or the overall weight of the drum.

SUMMARY OF THE DISCLOSURE

An electronic drum may include, but is not limited to, a cylindrical tubular member, a striking surface head, a striking surface hoop, a rear surface hoop, a plurality of coupling devices, and a striking surface sensor. The striking surface head may be stretched across a first end of the tubular member. The striking surface hoop may be configured to hold down an outer peripheral edge of the striking surface head. The rear surface hoop may be disposed on a second end of the tubular member. The plurality of coupling devices may be configured to stretch the striking surface head by coupling and clamping the rear surface hoop to the striking surface hoop. The striking surface sensor may be disposed between the rear surface hoop and the striking surface hoop to be in contact with the striking surface head to detect vibrations of the striking surface head. The striking surface sensor may be operatively connected to the rear surface hoop.

In such embodiments, because the striking surface sensor may be operatively connected to the rear surface hoop, the striking surface sensor may be fixed securely irrespective of rigidity of the tubular member. Thus, material for forming the tubular member may be selected freely, for example, in consideration of cost and/or overall weight of the drum.

In various embodiments, the striking surface hoop may have an overhang portion extending from an outer peripheral portion of the striking surface hoop. The overhang portion may have a plurality of holes. Each coupling device of the plurality of coupling devices may include a pipe-shaped member and at least one threaded rod member. The pipe-shaped member may have a threaded interior. One of the at least one threaded rod member may be insertable through a respective hole of the overhang portion of the striking surface hoop and into the pipe-shaped member to mate with the pipe-shaped member.

In some embodiments, the rear surface hoop may have an overhang portion extending from an outer peripheral portion of the rear surface hoop. The coupling device may be configured to stretch the striking surface head by coupling and clamping the overhang portion of the rear surface hoop to the overhang portion of the striking surface hoop.

In such embodiments, because the pipe-shaped members couple the overhang portion of the rear surface hoop member and the overhang portion of the front surface hoop member, an outer peripheral surface of the tubular member may be made flat. Such embodiments may allow a sheet to be placed on and removed from the outer peripheral surface of the tubular member quickly and easily, for example, by removing the striking surface hoop member and the striking surface head.

In further embodiments, the overhang portion of the rear surface hoop may have a plurality of holes. The at least one threaded rod member may comprise a first threaded rod member and a second threaded rod member. The first threaded rod member may be insertable through the respective hole of the plurality of holes of the overhang portion of the striking surface hoop and into the pipe-shaped member to mate with the pipe-shaped member. The second threaded rod member may be insertable through a respective hole of the plurality of holes of the overhang portion of the rear surface hoop and into the pipe-shaped member to mate with the pipe-shaped member.

In some embodiments, the electronic drum may further include a rim sensor and a sensor support member. The rim sensor may be configured to detect vibration of the striking surface hoop. The sensor support member may be for supporting the striking surface sensor. The rear surface hoop may be for supporting the rim sensor, the sensor support member, and the striking surface sensor. The sensor support member, the coupling device, the striking surface hoop, and the rear surface hoop may be made of a material comprising metal.

In such embodiments, because the sensor support member, the coupling device, the striking surface hoop, the rear surface hoop may be made of a material comprising metal, a transmission path of vibration produced by striking the striking surface hoop member to the rim sensor may be made of metal. Thus, absorption of vibration by another component may be suppressed. Accordingly, the vibration produced by striking the striking surface hoop member can be transmitted efficiently to the rim sensor. In addition, because the striking surface hoop is operatively connected with the rear surface hoop, which supports the rim sensor, via the coupling device, an output waveform of the rim sensor can be maintained (e.g., maintain sharpness or otherwise prevent dulling of the output wave form) irrespective of form, material, and/or flexibility of the tubular member.

In various embodiments, the drum may further include one of a rod-shaped and a plate-shaped support leg member coupled to the rear surface hoop. In such embodiments, because the support leg member, which may be coupled to the rear surface hoop, may allow the drum to be raised perpendicular to a floor surface. The support leg member may be held solidly irrespective of rigidity of the tubular member. Thus, material for forming the tubular member may be selected freely, for example, in consideration of cost and/or overall weight of the drum.

In various embodiments, the drum may further include a plate-shaped attaching hardware fixing member coupled to the rear surface hoop. The attaching hardware fixing member may be for supporting the electronic drum on an instrument stand.

In such embodiments, because the attaching hardware fixing member may be coupled to the rear surface hoop, the electronic drum may be securely attached to the instrument stand irrespective of rigidity of the tubular member. Thus, material for forming the tubular member may be selected freely, for example, in consideration of cost and/or overall weight of the drum.

A percussion instrument may include, but is not limited to, a shell, a head, a first hoop member, a second hoop member, a plurality of coupling devices, and a sensor. The head may be arranged across a first end of the shell. The first hoop member may be configured to hold down the head against the shell. The second hoop member may be arranged on a second end of the shell. The plurality of coupling devices may be for operatively connecting the first hoop member and the second hoop member. The plurality of coupling devices may be configured for stretching the head. The sensor may be adjacent the head. The sensor may be configured to detect vibration of the head. The sensor may be operatively connected to the second hoop member.

In various embodiments, the first hoop member may have an overhang portion extending from an outer peripheral portion of the first hoop member. The second hoop member may have an overhang portion extending from an outer peripheral portion of the second hoop member. Each of the plurality of coupling devices may be for operatively connecting the overhang portion of the first hoop member and the overhang portion of the second hoop member.

In various embodiments, each of the plurality of coupling devices may include an elongated body and at least one rod member. The elongated body may have an interior. The at least one rod member may be insertable into the interior of the elongated body.

In some embodiments, the at least one rod member may include a first rod member and a second rod member. The first rod member may be insertable through a hole in the first hoop member and into a first end of the elongated body to operatively connect the coupling device to the first hoop member. The second rod member may be insertable through a hole in the second hoop member and into a second end of the elongated body to operatively connect the coupling device to the second hoop member.

In various embodiments, the percussion instrument may further include a rim sensor. The rim sensor may be configured to detect vibration of the first hoop member. The rim sensor may be operatively connected to the second hoop member. In some embodiments, the first hoop member, the second hoop member, and the plurality of coupling devices may comprise a material made of metal.

In some embodiments, the percussion instrument may include a support base. The support base may be for supporting the rim sensor. The support base may be operatively connected to the second hoop member. In further embodiments, the first hoop member, the second hoop member, the plurality of coupling devices, and the support base may comprise a material made of metal.

In various embodiments, the percussion instrument may include a support member. The support member may be for supporting the sensor. The support member may be operatively connected to the second hoop member.

In various embodiments, the percussion instrument may include a leg support member. The leg support member may be operatively connected to the second hoop member. The leg support member may be for supporting the percussion instrument on a floor surface such that the head is substantially perpendicular to the floor surface.

In various embodiments, the percussion instrument may include an attachment member. The attachment member may be attachable to an instrument stand to support the percussion instrument on a floor surface. The attachment member may be operatively connected to the second hoop member. In various embodiments, the percussion instrument may comprise one of a tom-tom, bass drum, and snare drum.

A method of manufacturing a percussion instrument may include, but is not limited to, any one or combination of: (i) providing a shell; (ii) arranging a head across a first end of the shell; (iii) configuring a first hoop member to hold down the head against the shell; (iv) arranging a second hoop member on a second end of the shell; (v) operatively connecting the first hoop member and the second hoop member with a plurality of coupling devices, the plurality of coupling devices configured for stretching the head; and (vi) arranging a sensor adjacent the head, the sensor configured to detect vibration of the head, the sensor operatively connected to the second hoop member.

DETAILED DESCRIPTION

Figure 1:
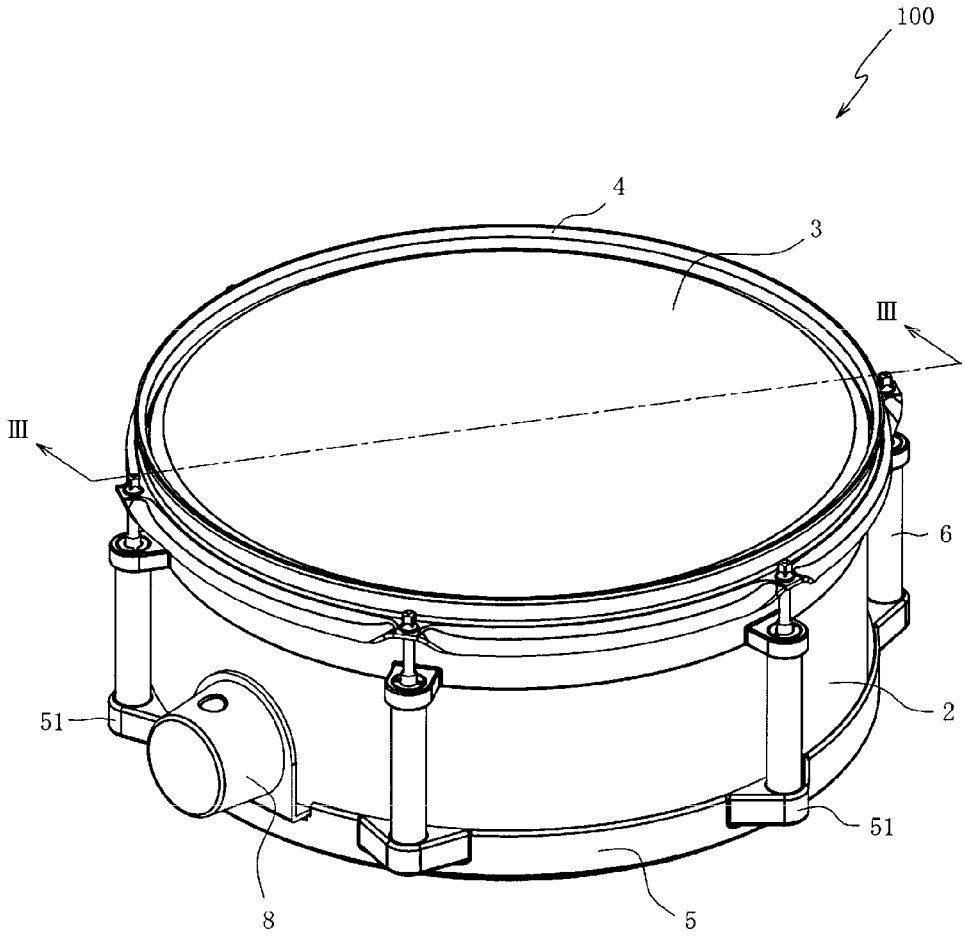
FIG. 1 is a perspective view of a percussion instrument according to an embodiment of the present invention.

FIG. 1 is a perspective view of a percussion instrument, such as a tom-tom 100, according to an embodiment of the present invention. The tom-tom 100 may be an electronic percussion instrument played by employing a stick for striking the tom-tom 100. The tom-tom 100 may comprise a shell (or body) 2, a head (or membrane) 3, a first hoop member 4, a second hoop member 5, a plurality of coupling devices 6, and attaching hardware 8. The shell 2 may be a tubular member formed in a cylindrical shape open at both ends. The head 3 may be stretched across a first end of the shell 2 to provide a striking surface. In some embodiments, the head 3 may be made of (but not limited to) a flexible material, such as a soft synthetic resin, an elastomer, rubber, and/or the like. In other embodiments, the head 3 may be made of any suitable material.

The first hoop member 4 may be arranged along an outer peripheral edge of the head 3 to hold the head 3 against the shell 2. The second hoop member 5 may be arranged on a second end of the shell 2 opposite the first end of the shell 2. Either one or both of the first hoop member 4 and the second hoop member 5 may be made of any suitably rigid material, such as (but not limited to) metal, plastic, composite materials, ceramic, glass, synthetic resin, wood, and/or the like.

The plurality of coupling devices 6 may be configured to operatively connect the first hoop member 4 and the second hoop member 5 to stretch the head 3. As will be discussed later, the plurality of coupling devices 6 may be adjusted to stretch the head 3 accordingly. The attaching hardware 8 may be operatively connected to a drum stand (not shown) to support the tom-tom 100 on the drum stand.

Figure 2:
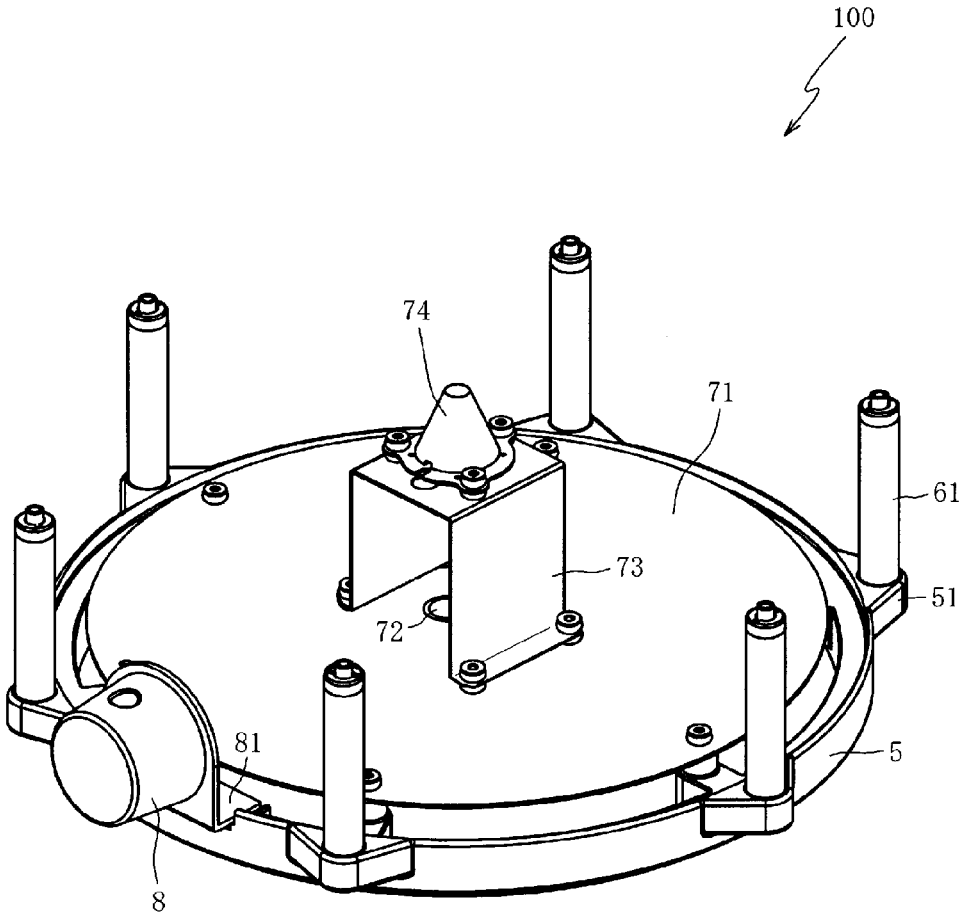
FIG. 2 is a perspective view of an internal configuration of a percussion instrument according to an embodiment of the present invention.

FIG. 2 is a perspective view of an internal configuration of a percussion instrument, such as the tom-tom 100, according to an embodiment of the present invention. In this view the shell 2 (e.g., FIG. 1), the head 3 (e.g., FIG. 1), and the first hoop member 4 (e.g., FIG. 1) have been removed from the tom-tom 100.

With reference to FIGS. 1 and 2, in various embodiments, the tom-tom 100 may include a sensor 74 and a rim sensor 72. The sensor 74, which will be discussed later, may be a sensor, detector, or the like for detecting vibration of the head 3. The sensor 74 may be, but is not limited to, a truncated cone or the like. The rim sensor 72, which will be discussed later, may be a sensor, detector, or the like for detecting vibration of the first hoop member (or rim) 4.

In various embodiments, a musical tone system (not shown) may control a sound source based on detected signals from the sensor 74 and the rim sensor 72 based on the striking of each sensor. A musical tone generated by the musical tone system may be emitted from a speaker system via an amplifier system.

In some embodiments, the tom-tom 100 may include a support base 71 arranged within the shell 2. The support base 71 may be attached or otherwise operatively connected to an inner peripheral surface of the second hoop member 5. In particular embodiments, the support base 71 may be fixed to the second hoop member 5 with bolts, screws, and/or the like. In other embodiments, the support base 71 may be fixed to the second hoop member 5 in any suitable manner including, but not limited, a friction fitting, snap fitting, an adhesive, welding, unitary construction, and/or the like. The support base 71 may be made of metal or the like. In other embodiments, the support base 71 may be made of any suitable rigid material, such as a synthetic resin, plastic, glass, composite materials, wood, and/or the like.

In some embodiments, the rim sensor 72 may be arranged at a center position of a top surface (i.e., facing the head 3) of the support base 71. In other embodiments, the rim sensor 72 may be arranged at any other suitable position.

In further embodiments, a support member 73 for supporting the sensor 74 may be arranged on the support base 71. The support member 73 (and the sensor 74) may be arranged at a center position of a top surface (i.e., facing the head 3) of the support base 71, for example, over the rim sensor 72. In other embodiments, the support member 73 (and the sensor 74) may be arranged at any other suitable position. In particular embodiments, the support member 73 may have a cross-section of an inverted letter "U" having a flat top. The sensor 74 may be arranged on the support member 73, for example on the top of the inverted "U."

The attaching hardware 8 may comprise a fixing member 81 operatively connected to the tom-tom 100 to allow the tom-tom to be securely fixed to an instrument stand (not shown). For example, the fixing member 81 may be fixed to the inner peripheral side (or other suitable portion) of the second hoop member 5 (or other suitable component). Therefore, the tom-tom 100 may be securely attached to the instrument stand irrespective of rigidity of the shell 2. In particular embodiments, the fixing member 81 may have an "L"-shaped cross-section.

Figure 3:
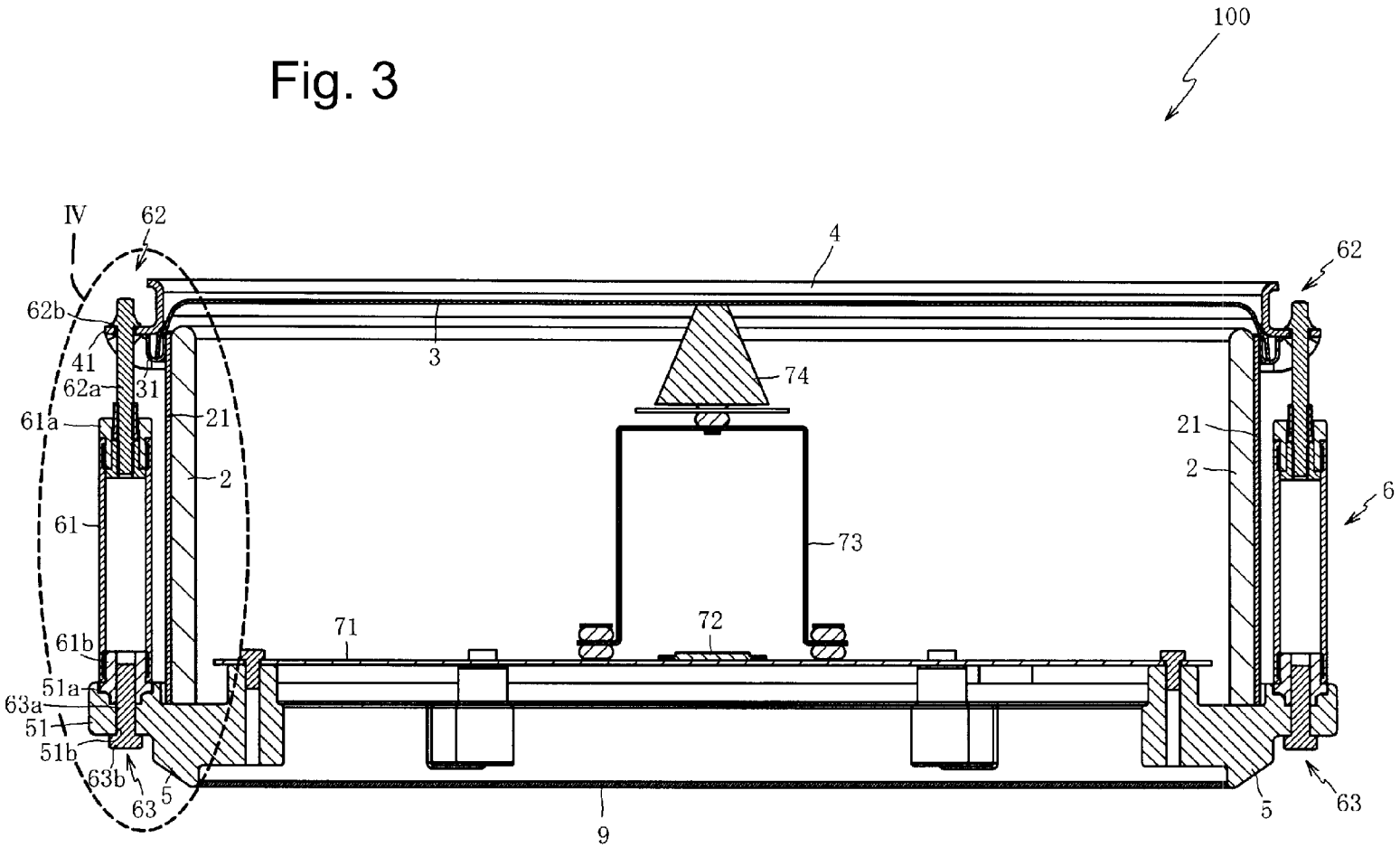
FIG. 3 is a lateral cross-section view of a percussion instrument along the line III-III of FIG. 1 according to an embodiment of the present invention.
Figure 4:
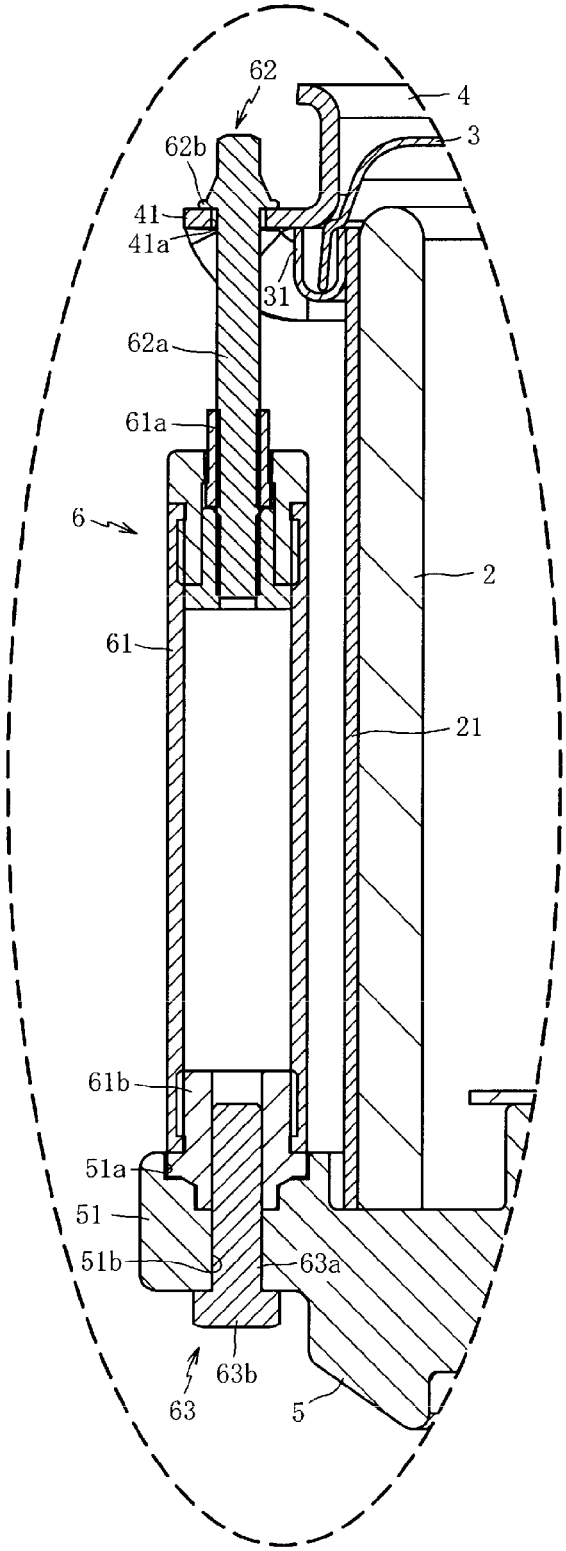
FIG. 4 is an expanded view of a portion of a percussion instrument in the IV portion of FIG. 3 according to an embodiment of the present invention.

FIG. 3 is a lateral cross-section view of a percussion instrument, such as the tom-tom 100, along the line III-III of FIG. 1 according to an embodiment of the present invention. FIG. 4 is an expanded view of a portion of a percussion instrument, such as the coupling section 6 of the tom-tom 100, in the IV portion of FIG. 3 according to an embodiment of the present invention.

With reference to FIGS. 1-4, the outer peripheral edge of the head 3 may be held in a frame 31, which may be fit to the first end of the shell 2. The first hoop member 4 may hold down the frame 31 against the first end of the shell 2 from above. The first hoop member 4 may include a plurality of overhang portions 41 projecting outward from an outer peripheral portion of the first hoop member 4.

In some embodiments, the first hoop member 4 may include six equally spaced overhang portions 41. In other embodiments, any number of overhang portions 41 may be provided. In other embodiments, the overhang portions 41 need not be equally spaced around the first hoop member 4. Reference may be made to an overhang portion 41 of the plurality of overhang portions 41 as applying to all other overhang portions 41 of the plurality of overhang portions 41, unless otherwise noted. The overhang portion 41 may include a hole 41*a*. The hole 41*a* of the first hoop member 4 may have a diameter larger than an outer diameter of the engaging section 62*a* of the first rod member 62, and may have a diameter smaller than an outer diameter of the head 62*b* of the first rod member 62.

The second hoop member 5 may include a plurality of overhang portions 51 projecting outward from an outer peripheral portion of the second hoop member 5. In some embodiments, the second hoop member 5 may include six equally spaced overhang portions 51. In other embodiments, any number of overhang portions 51 may be provided. In other embodiments, the overhang portions 51 need not be equally spaced around the second hoop member 5. Reference may be made to an overhang portion 51 of the plurality of overhang portions 51 as applying to all other overhang portions 51 of the plurality of overhang portions 51, unless otherwise noted.

The head 3 may be stretched across the first end of the shell 2 (the top in FIG. 3). A cover 9 may be provided over the second end of the shell 2 (the bottom in FIG. 3). The cover 9 may have a disk-like shape and may be attached or otherwise operatively connected to the second hoop member 5. The first hoop member 4, which may hold down the frame 31, may be operatively connected to the second hoop member 5 via the plurality of coupling devices 6. The rim sensor 72 may be arranged on the support base 71 that has been coupled to the second hoop member 5.

In particular embodiments, the first hoop member 4, the plurality of coupling devices 6, the second hoop member 5, and the support base 71 may be each made of metal or the like. In such embodiments, in a case where the first hoop member 4 is struck, vibrations may be transmitted to the rim sensor 72 efficiently while limiting absorption of the vibrations.

In some embodiments, each of the coupling devices 6 may be arranged at equal intervals. In such embodiments, because the coupling device 6 may be a transmission path along which the vibrations are transmitted from the first hoop member 4 to the rim sensor 72, the vibrations of the first hoop member 4 may be uniformly transmitted to the rim sensor 72 irrespective of where the first hoop member 4 was struck. Moreover, in such embodiments, dulling of an output waveform of the rim sensor 72 may be limited.

The sensor 74 may be arranged in the shell 2 so that an upper end portion of the sensor 74 is in contact with the head 3 (e.g., bottom surface of the head 3). The sensor 74 may be operatively connected to the second hoop member 5. For instance, the sensor 74 may be attached to the support member 73 that may be attached to the support base 71 that may be attached to the second hoop member 5. In such embodiments, vibrations may be detected reliably irrespective of rigidity of the shell 2 when the head 3 is struck. Accordingly, material for construction of the shell 2 may be selected freely, for example in consideration of costs and overall weight of the tom-tom 100.

Because the sensor 74 may be operatively connected to the second hoop member 5, position accuracy with respect to the sensor 74 and the head 3 may be increased. Accordingly, the sensor 74 may stably detect vibrations when the head 3 is struck.

The shell 2 may be sandwiched or otherwise arranged between the first hoop member 4 and the second hoop member 5. A sheet 21 may be disposed on an outer peripheral surface of the shell 2 to cover the outer peripheral surface of the shell 2. The sheet 21 may come in a variety of colors, designs, and/or the like or be decorated by the user. Accordingly, the shell 21 can be decorated by the user by placing the sheet 21 (or replacing the sheet 21 with another sheet) on the outer peripheral surface of the shell 2 and/or decorating the sheet 21 with various patterns, colors, and/or the like.

The sheet 21 may be fixed or otherwise arranged on the outer peripheral shell of the shell 2. For instance, a first edge (e.g., the bottom in FIG. 3) of the sheet 21 may be arranged between second hoop member 5 and the outer peripheral surface of the shell 2. Such embodiments may prevent the sheet 21 from coming away from the shell 2 and may provide for a more attractive appearance. In other embodiments, the sheet 21 may be fixed or otherwise arranged on the outer peripheral surface 2*e* of the shell 2 in any suitable matter including, but not limited to, a clamp member, fastening member (e.g., screw), and/or the like.

With the first hoop member 4 and the head 3 removed from the shell 2, the first edge of the sheet 21 may be removed from the second hoop member 5 and the shell 2. As such, the sheet 21 can be arranged and removed on the outer peripheral surface of the shell 2 quickly and easily. In various embodiments in which the sheet 21 is secured without any fastening members or clamps, which may require apertures, slits, or the like in the sheet 21, the sheet 21 may be formed as a simple sheet or band (e.g., substantially rectangular). In other embodiments, the sheet 21 may be omitted altogether, for example, in a case where the user prefers the appearance of the shell 2 itself. The sheet 21 may be made of any suitably flexible material having sufficient rigidity, such as (but not limited to) metal, plastic, composite material, paper, wood, and/or the like. In further embodiments, a second edge (e.g., the top in FIG. 3), opposite the first edge, of the sheet 21 may be arranged between the frame 31 and the outer peripheral surface of the shell 2.

In some embodiments, first and second ends of the sheet 21, which may be substantially perpendicular to the first edge and the second edge of the sheet 21, may be arranged, for example, on opposite sides of the attachment hardware 8. The first and second ends of the sheet 21 may be held against the outer peripheral surface of the shell 2 by attaching the attachment hardware 8. Such embodiments may prevent the sheet 21 from coming away from the shell 2 and may provide for a more attractive appearance. In other embodiments, the sheet 21 may be fixed or otherwise arranged on the outer peripheral surface of the shell 2 in any suitable matter including, but not limited to, a clamp member, fastening member (e.g., screw), and/or the like.

The coupling device 6 may include an elongated body 61 (or any other suitably shaped body, such as a pipe-shaped member, or the like)), a first rod member 62, and a second rod member 63. The elongated body 61 may include an inner portion for receiving an engaging section 62*a* of the first rod member 62 and an engaging section 63*a* of the second rod member 63. The first rod member 62 may be configured to pass through the hole 41*a* of the first hoop member 4 into the inner portion of the elongated body 61. The first rod member 62 may be secured (e.g., screwed) by turning a head 62*b* of the first rod member 62 to bring the first hoop member 4 toward the elongated body 61.

The second rod member 63 may be configured to pass through the hole 51*a* of the second hoop member 5 into the inner portion of the elongated body 61. The second rod member 63 may be secured (e.g., screwed) by turning a head 63*b* of the second rod member 62 to bring the second hoop member 5 toward the elongated body 61.

In further embodiments, the inner portion of the elongated body 61 may be threaded to receive the engagement portion 62*a*, which may be correspondingly threaded, of the first rod member 62 and/or the engagement portion 63*a*, which may be correspondingly threaded, of the second rod member 63. Thus, the first rod member 62 and/or the second rod member 63 may be inserted through the first hoop member 4 and/or the second hoop member 5, respectively, into the inner portion of the elongated body 61 and screwed into place to bring the head 3 and/or the second hoop member 5 toward the elongated body 61. As such, the head 3 may be stretched with continued movement of the head 3 toward the elongated body 61 (e.g., further screwing of the first rod member 62).

In some embodiments, the elongated body 61 may include a nut-shaped member 61*a* (or other suitably shaped body) for receiving the first rod member 62. Thus, by fitting the first rod member 62 into the nut-shaped member 61*a* of the elongated body 61, the first hoop member 4 may be operatively connected to the second hoop member 5. Further twisting (e.g., screwing) of the first rod member 62 may bring the first hoop member 4 toward the elongated body 61 to stretch the head 3 as desired. The first hoop member 4 and the head 3 may be removed by loosening the first rod member 62 and removing the first rod member 62 from the elongated body 61.

In some embodiments, the elongated body 61 may include a nut-shaped member 61*b* (or other suitably shaped body) for receiving the second rod member 63. Thus, by fitting the second rod member 63 into the nut-shaped member 61*b* of the elongated body 61, the first hoop member 4 may be operatively connected to the second hoop member 5. Further twisting (e.g., screwing) of the first rod member 62 may bring the second hoop member 5 toward the elongated body 61 to stretch the head 3 as desired. The second hoop member 5 may be removed by loosening the second rod member 63 and removing the second rod member 63 from the elongated body 61.

In some embodiments, the nut-shaped member 61*a* and/or the nut-shaped member 61*b* may be integral with the elongated body 61. In other embodiments, the nut-shaped member 61*a* may be a separate component operatively connected (e.g., fastened) with the elongated body 61.

In particular embodiments, the engaging section 62*a* of the first rod member 62 may be screwed and fit into a threaded section of the nut-shaped member 61*a*. The head 62*b* of the first rod member 62 may have a diameter larger than an outer diameter of the engaging section 62*a* of the first rod member 62. In some embodiments, the engaging section 63*a* of the second rod member 63 may be screwed and fit into a threaded section of the nut-shaped member 61*b*. The head 63*b* of the second rod member 63 may have a diameter larger than an outer diameter of the engaging section 63*a* of the second rod member 63. The hole 41*a* may have a diameter larger than an outer diameter of the engaging section 62*a* of the first rod member 62 and smaller than an outer diameter of the head 62*b* of the first rod member 62.

In various embodiments, the elongated body 61 may be operatively connected or otherwise supported on the overhang portion 51. For instance, the overhang portion 51 may include a depression 51*a* into which the elongated body 61 is inserted at least partially to support the elongated body 61. The depression 51*a* may be aligned with the hole 51*b* into which the second rod member 63 is inserted. The hole 51*b* of the overhang portion 51 may have a diameter greater than the engaging section 63*a* of the second rod member 63 and smaller than the head 63*b* of the second rod member 63. As such, the engaging section 63*a* of the second rod member 63 may be inserted through the hole 51*b* of the overhang portion 51 and screwed and fit into the nut-shaped member 61*b* with the head 63*b* held by the overhang portion 51 to prevent the second rod member 63 from being removed accidentally.

In some embodiments, the nut-shaped member 61*b* may have a polygonal shape. In other embodiments, the nut-shaped member 61*b* may have any suitable shape. In various embodiments, the nut-shaped member 61*b* may be arranged such that a portion of the nut-shaped member 61*b* protrudes out of the elongated body 61. In some embodiments, the depression 51*a* may be shaped or otherwise formed to receive the portion of the nut-shaped member 61*b* that protrudes out of the elongated body 61 and/or the elongated body 61 itself. As such, rotation of the nut-shaped member 61*b* and/or the elongated body 61 may be prevented, which may allow the second rod member 63 to be secured to the nut-shaped member 61*b* more reliably.

The engaging section 62*a* of the first rod member 62 may be inserted through the hole 41*b* of the overhang portion 41 and screwed and fit into the nut-shaped member 61*a* with the head 62*b* held by the overhang portion 41 to prevent the first rod member 62 from being removed accidentally. Thus, the first hoop member 4 may be brought toward the overhang portion 4*a*, for example, by screwing the first rod member 62 into the nut-shaped member 61*a* to stretch the head 3.

Figure 5:
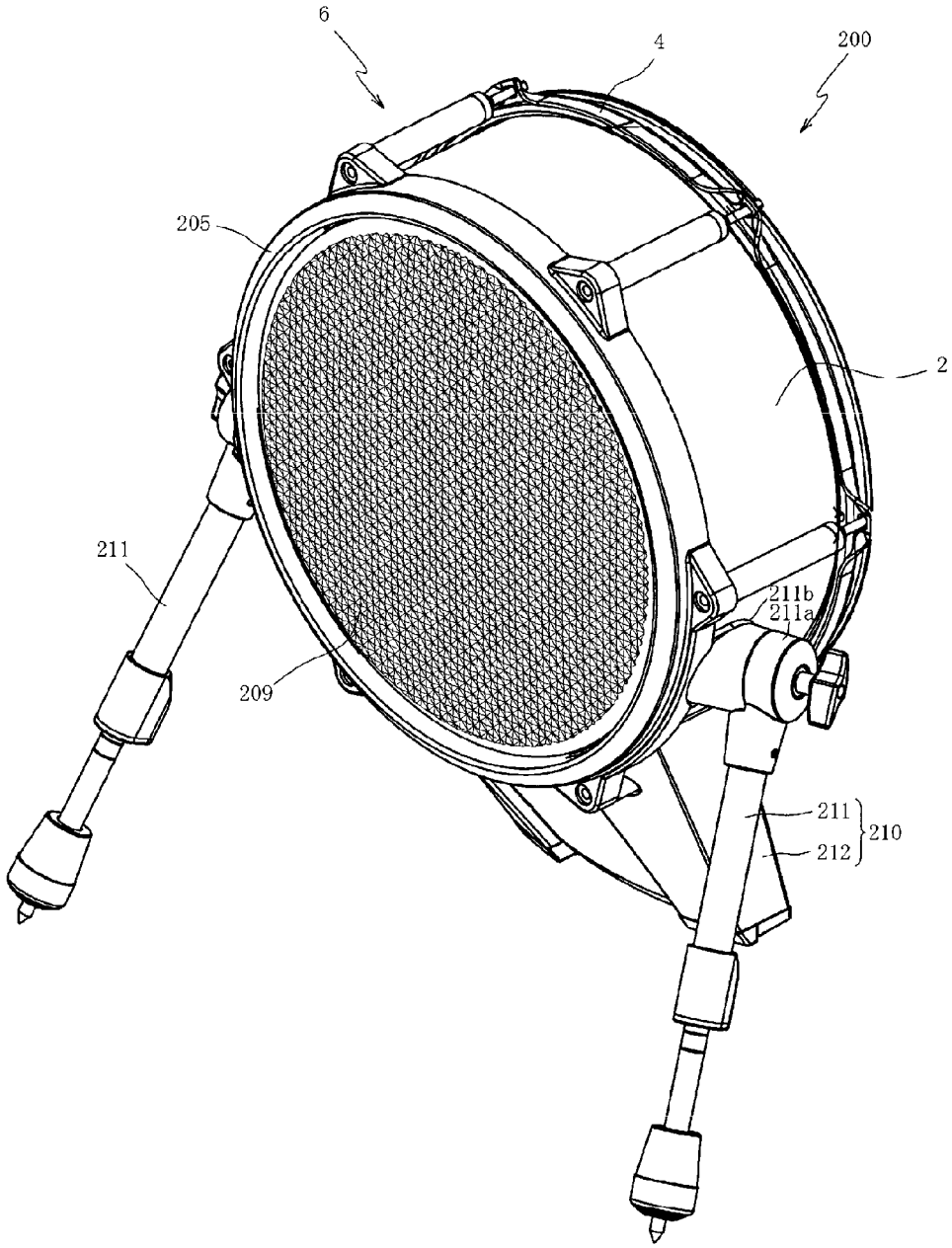
FIG. 5 is a perspective view of another percussion instrument according to an embodiment of the present invention.
Figure 6:
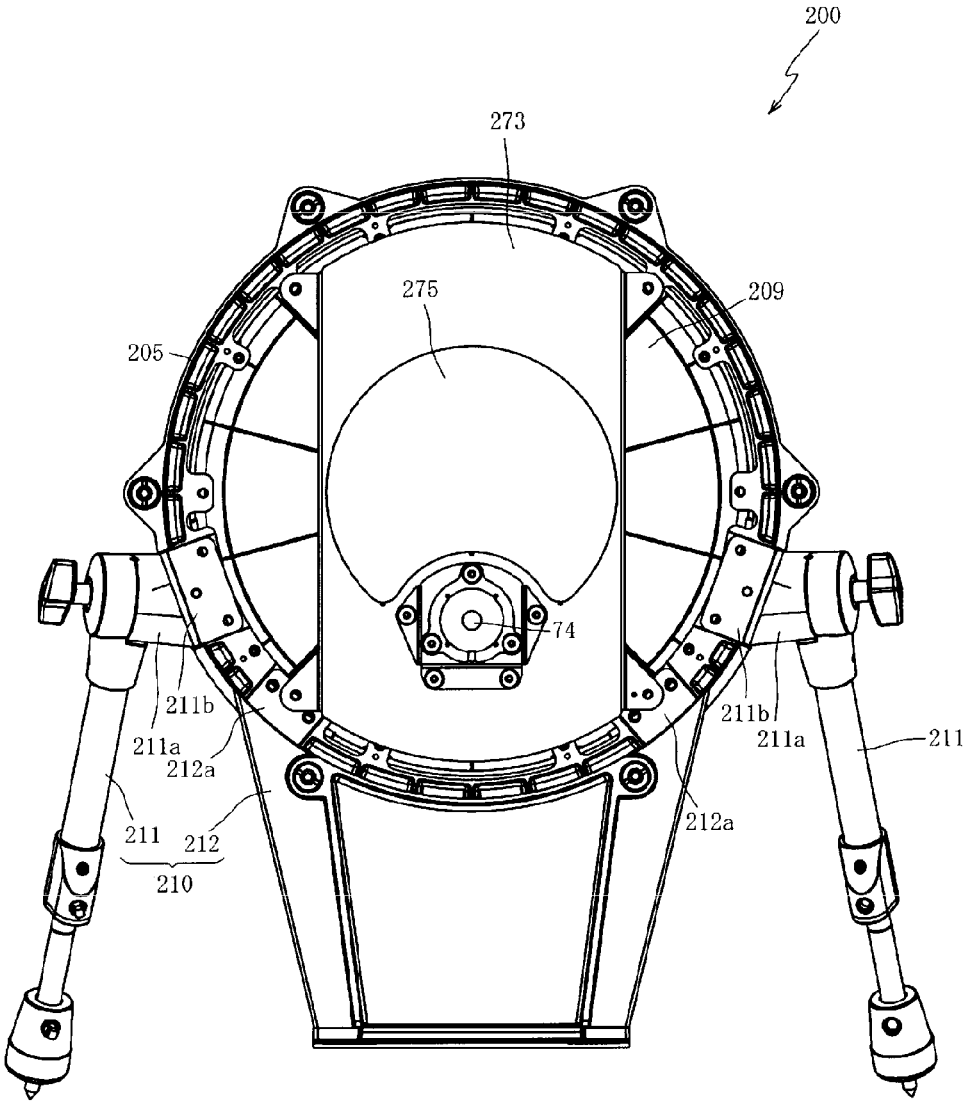
FIG. 6 is a view of an internal configuration of a percussion instrument according to an embodiment of the present invention.
Figure 7:
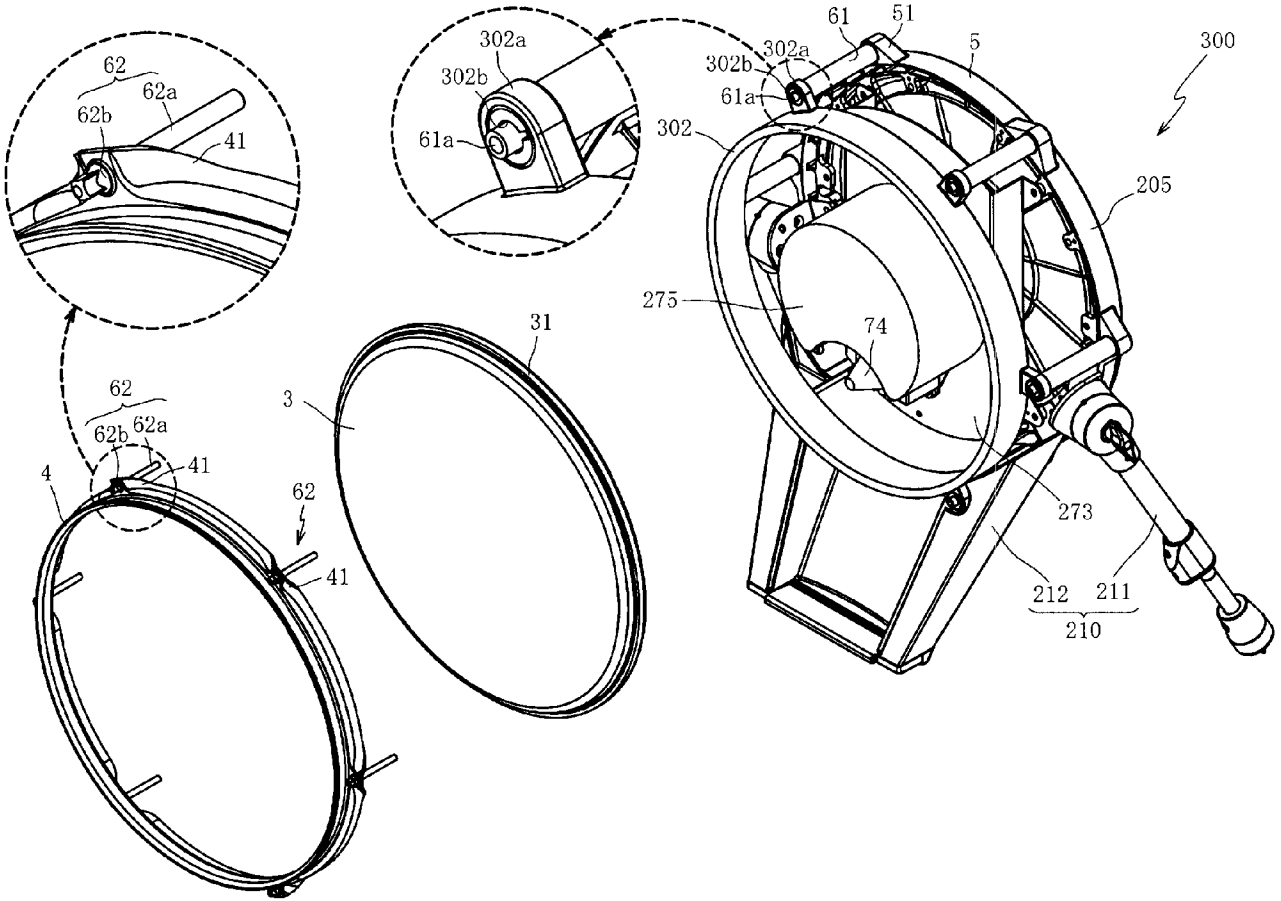
FIG. 7 is an exploded perspective view of another percussion instrument according to an embodiment of the present invention.

In addition, some or all of the features shown in FIGS. 5-7 may be combined in various ways and included in the embodiments shown in FIGS. 1-4. Likewise, it should be understood that any of the features of the embodiments of FIGS. 1-4 may be combined or otherwise incorporated into any other embodiment(s) of FIGS. 1-4 as well as any other embodiment herein discussed.

FIG. 5 is a perspective view of a percussion instrument, such as bass drum 200, according to an embodiment of the present invention. FIG. 6 is a view of an internal configuration of a percussion instrument, such as the bass drum 200, according to an embodiment of the present invention. In this view of FIG. 6, the shell 2 (e.g., FIG. 1), the head 3 (e.g., FIG. 1), and the first hoop member 4 (e.g., FIG. 1) have been removed from the bass drum 200.

Reference numbers of FIGS. 5 and 6 and related explanations that are the same as those discussed in the disclosure have been omitted. In addition, some or all of the features shown in FIGS. 1-4 and 7 may be combined in various ways and included in the embodiments shown in FIGS. 5 and 6. Likewise, it should be understood that any of the features of the embodiments of FIGS. 5 and 6 may be combined or otherwise incorporated into any other embodiment(s) of FIGS. 5 and 6 as well as any other embodiment herein discussed.

With reference to FIGS. 1-6, the bass drum 200 may be an electronic drum played by striking the bass drum 200 (not shown in the drawing) with a foot pedal (not shown) or the like. The bass drum 200 may comprise the shell (or body) 2, the head (or membrane) 3, the first hoop member 4, a second hoop member 205, and the coupling device 6.

In some embodiments, a striking surface of the bass drum 200 may be supported to be substantially perpendicular to a floor surface. For instance, the bass drum 200 may include a leg support member 210 for supporting the bass drum 200. The leg support member 210, for example, may be shaped in any suitable manner, such as (but not limited to) rod-shaped, plate-shaped, and/or the like.

The bass drum 200 may include a cover 209, which may be similar to the cover 9. In some embodiments, the cover 209 may be configured to disperse light in a case where the cover 209 is illuminated. For example, in particular embodiments, the cover 209 may include a plurality of small protrusions. For example, in particular embodiments, the cover 209 may be curved slightly (e.g., toward the front surface side). As such, in a case where the cover 209 is illuminated, light from the illumination may be dispersed rather than being reflected in a single direction. Thus, for example, the light is not reflected directly toward the audience. In some embodiments, a space may be provided between the cover 209 and the second hoop member 205. In such embodiments, air between the two components can better escape, thus reducing a volume of a sound produced by striking the head 3.

A support member 273 for supporting the sensor 74 may be coupled or otherwise operatively connected to the second hoop member 205. In some embodiments, a shock absorber member 275 and the sensor 74 may be arranged on the support member 273. The shock absorber member 275 may be configured to suppress excessive vibration of the head 3 by absorbing vibration when the head 3 is struck. The shock absorber member 275 may be made of a material comprising (but not limited to) a flexible material, such as (but not limited to) a polyurethane, or other sponge-like material, and/or the like.

In various embodiments, the leg support member 210 may comprise two or more legs 211 and a stand 212. In some embodiments, the legs 211 may be rod-shaped. In some embodiments, the stand 212 may be plate-shaped. In other embodiments, the legs 211 and/or the stand 212 may be shaped in any suitable manner for supporting the bass drum 200.

With respect to an individual leg, the leg 211 may be configured to be extendable and retractable. The leg 211 may be configured to be rotatable about the bass drum 200. For example, the leg support member 210 may include a leg support member 211*a* configured to allow rotation of the leg 211. As such, the bass drum 200 may be supported stably on the floor surface by adjusting a length of the leg 211 and/or rotating the leg 211.

The leg 211 may include a coupling member 211*b*. A first end of the coupling member 211*b* may be connected (e.g., with a fastener or the like) with the second hoop member 205, and a second end of the coupling member 211*b* may be connected with the leg support member 211*a*. In some embodiments, the coupling member 211*b* may have a cross-section in a shape of the letter "L."

In various embodiments, the stand 212 may be formed to have a cross-section shaped like the letter "U" with a flat bottom. In some embodiments, the stand 212 may include, for example, a depression in which a pedal (not shown) for striking the head 3 may be arranged.

The stand 212 may have a ground surface for contacting the floor surface. A surface of the stand 212 opposite the ground surface may be shaped to match a shape of the shell 2 of the bass drum 200. In some embodiments, the stand 21 may include one or more coupling members 212*a*. With respect to an individual coupling member 212*a*, a first end of the coupling member 212*a* may be connected to the stand 212 (e.g., the surface shaped to match the shape of the shell), and a second end may be operatively connected (e.g., with a fastening member, or the like) to the second hoop member 205. In particular embodiments, the coupling member 212*a* may have a cross-section in a shape of a letter "L."

The legs 211 and the stand 212 may be coupled or otherwise operatively connected to the second hoop member 205. Accordingly, the support leg member 210 may be held firmly irrespective of rigidity of the shell 2. Thus, material for construction of the shell 2 may be selected freely, for example in consideration of costs and overall weight of the bass drum 200.

In some embodiments, the second hoop member 205 may include depressions into which the leg coupling members 211*b* and the stand coupling members 212*a* may be inserted. As such, the leg support member 210 may be positioned easily when the leg coupling members 211*b* and the stand coupling members 212*a* are fixed. In such embodiments, positioning of the leg support member 210 may be more appropriate than in embodiments where, for example, bolts are used to fastening the legs 211 and stand 212 to the shell 2. Thus, positioning accuracy of the support leg member 210 may be increased, and the bass drum 200 can be stably arranged on the floor surface.

FIG. 7 is an exploded perspective view of a percussion instrument, such as bass drum 300, according to an embodiment of the present invention. Reference numbers of FIG. 7 and related explanations that are the same as those discussed in the disclosure have been omitted. In addition, some or all of the features shown in FIGS. 1-6 may be combined in various ways and included in the embodiments shown in FIG. 7. Likewise, it should be understood that any of the features of the embodiments of FIG. 7 may be combined or otherwise incorporated into any other embodiment(s) of FIG. 7 as well as any other embodiment herein discussed.

With reference to FIGS. 1-7, the bass drum 300 may be an electronic drum played by striking the bass drum 300 (not shown in the drawing) with a foot pedal (not shown) or the like. The bass drum 300 may comprise a shell (or body) 302, the head (or membrane) 3, the first hoop member 4, a second hoop member 205, and the coupling device 6.

In some embodiments, the shell 302 may include six equally spaced overhang portions 302*a* extending from an outer peripheral surface of the shell 302. With respect to an individual overhang portion 302*a*, the overhang portion 302*a* may have a hole 302*b* in which the nut-shaped member 61*a* may be arranged to allow the first rod member 62 to fasten the overhang portion 302*a* to the elongated body 61.

The head may be stretched across a first end of the shell 302. The rod member 62 may be fastened (e.g., screwed) through the hole 41*a* of the overhang portion 41 of the first hoop member 4 to the nut-shaped member 61*a* to stretch the head 3. In such embodiments, a length of the shell 302 in an axial direction may be smaller, thus reducing cost of materials and/or reducing an overall weight of the bass drum 300.

With reference to FIGS. 1-7, in various embodiments, six coupling devices (e.g., 6) are disposed at equal intervals. In other embodiments, any number of coupling devices may be provided. In other embodiments, the coupling devices need not be disposed at equal intervals.

In various embodiments, the percussion instrument may comprise the tom-tom (e.g., 100) or the bass drums (e.g., 200, 300). In other embodiments, the percussion instruments may comprise other percussion instruments, such as (but not limited to) a snare drum, tom-tom, bass drum, or the like.

In various embodiments, the attaching hardware (e.g., 8) may be fixed to one surface of the fixing member (e.g., 81), which may have an "L"-shaped cross-section with an other surface of the fixing member fixed to an inner peripheral portion of the second hoop member (e.g., 5). In other embodiments, the fixing member may be a plate-shaped member having a "I"-shaped cross-section with a first end fixed to the inner peripheral portion of the second hoop member and a second end fixed to the attaching hardware. In other embodiments, the attaching hardware and the fixing member may be a single, unitary member.

In various embodiments, the percussion instrument (e.g., tom-tom 100) may include the rim sensor (e.g., 72) and the support base (e.g., 71). In other embodiments, the rim sensor (and the support base) may be omitted. For example, the bass drum (e.g., 200, 300) may omit the rim sensor (and the support base).

In various embodiments, the leg support member (e.g., 210) may comprise the at least two legs (e.g., 211) and the stand (e.g., 212). In other embodiments, the leg support member may include only one of the at least two legs and the stand. In other embodiments, the leg support member may include more than one stand.

In various embodiments, the sensor (e.g., 74) may be operatively connected to the second hoop member (e.g., 5, 205) via the support base (e.g., 71) and/or the support member (e.g., 73, 273). In other embodiments, the sensor may be attached directly to the second hoop member. In yet other embodiments, the sensor may be attached to another support member, which may be made of (but not limited to) metal or the like.

The embodiments disclosed herein are to be considered in all respects as illustrative, and not restrictive of the invention. The present invention is in no way limited to the embodiments described above. Various modifications and changes may be made to the embodiments without departing from the spirit and scope of the invention. The scope of the invention is indicated by the attached claims, rather than the embodiments. Various modifications and changes that come within the meaning and range of equivalency of the claims are intended to be within the scope of the invention.

What is claimed is:

1. An electronic drum, the electronic drum comprising:

a cylindrical tubular member;

a striking surface head stretched across a first end of the tubular member, and having a striking surface extending in a plane;

a striking surface hoop configured to hold down an outer peripheral edge of the striking surface head;

a rear surface hoop disposed on a second end of the tubular member;

a plurality of coupling devices configured to stretch the striking surface head by coupling and clamping to each of the rear surface hoop and the striking surface hoop, each of the coupling devices being separated from the cylindrical tubular member;

a striking surface sensor disposed between the rear surface hoop and the striking surface hoop to be in contact with the striking surface head to detect vibrations of the striking surface head; and a leg support member operatively connected to the rear surface hoop to support at least some of the weight of the cylindrical tubular member through the rear surface hoop, the leg support member for supporting the electronic drum on a floor surface, such that the striking surface defines a plane that is substantially perpendicular to the floor surface, the leg support member including a stand having a fixed length and angle relative to the plane of the striking surface, and at least one leg having a length extending in a longitudinal dimension in a direction from the rear surface hoop toward the floor surface when the leg support member supports the electronic drum on the floor surface, the longitudinal dimension of the leg being at an oblique angle relative to the plane of the striking surface, at least one of the length and the oblique angle of the leg being adjustable;

wherein the striking surface sensor is operatively connected to the rear surface hoop.

2. The electronic drum of claim 1, the striking surface hoop having an overhang portion extending from an outer peripheral portion of the striking surface hoop, the overhang portion having a plurality of holes;

each coupling device of the plurality of coupling devices comprising:

a pipe-shaped member, the pipe-shaped member having a threaded interior; and at least one threaded rod member, one of the at least one threaded rod member insertable through a respective hole of the plurality of holes of the overhang portion of the striking surface hoop and into the pipe-shaped member to mate with the pipe-shaped member.

3. The electronic drum of claim 2, the rear surface hoop having an overhang portion extending from an outer peripheral portion of the rear surface hoop; and each of the coupling devices configured to stretch the striking surface head by coupling and clamping to each of the overhang portion of the rear surface hoop and the overhang portion of the striking surface hoop.

4. The electronic drum of claim 3, the overhang portion of the rear surface hoop having a plurality of holes;

the at least one threaded rod member comprising a first threaded rod member and a second threaded rod member;

the first threaded rod member insertable through the respective hole of the plurality of holes of the overhang portion of the striking surface hoop and into the pipe-shaped member to mate with the pipe-shaped member; and the second threaded rod member insertable through a respective hole of the plurality of holes of the overhang portion of the rear surface hoop and into the pipe-shaped member to mate with the pipe-shaped member.

5. An electronic drum comprising:

a cylindrical tubular member;

a striking surface head stretched across a first end of the tubular member;

a striking surface hoop configured to hold down an outer peripheral edge of the striking surface head, the striking surface hoop having an overhang portion extending from an outer peripheral portion of the striking surface hoop, the overhang portion having a plurality of holes;

a rear surface hoop disposed on a second end of the tubular member;

a plurality of coupling devices configured to stretch the striking surface head by coupling and clamping to each of the rear surface hoop and the striking surface hoop, each of the coupling devices being separated from the cylindrical tubular member;

a striking surface sensor disposed between the rear surface hoop and the striking surface hoop to be in contact with the striking surface head to detect vibrations of the striking surface head;

a rim sensor configured to detect vibration of the striking surface hoop; and a sensor support member for supporting the striking surface sensor;

wherein the rear surface hoop supports the rim sensor, the sensor support member, and the striking surface sensor;

wherein the striking surface sensor is operatively connected to the rear surface hoop;

wherein the sensor support member, each of the coupling devices the striking surface hoop, and the rear surface hoop are made of a material comprising metal; and wherein each coupling device of the plurality of coupling devices comprising:

a pipe-shaped member, the pipe-shaped member having a threaded interior; and at least one threaded rod member, one of the at least one threaded rod member insertable through a respective hole of the plurality of holes of the overhang portion of the striking surface hoop and into the pipe-shaped member to mate with the pipe-shaped member.

6. The electronic drum of claim 1, wherein the stand comprises:

a plate-shaped support leg member coupled to the rear surface hoop.

7. The electronic drum of claim 5, the electronic drum further comprising:

a plate-shaped attaching hardware fixing member coupled to the rear surface hoop, the attaching hardware fixing member for supporting the electronic drum on an instrument stand.

8. A percussion instrument, the percussion instrument comprising:

a shell having an outer surface and a mass defining a weight;

a head arranged across a first end of the shell;

a first hoop member configured to hold down the head against the shell;

a second hoop member arranged on a second end of the shell;

a plurality of coupling devices connecting to each of the first hoop member and the second hoop member, the plurality of coupling devices configured for stretching the head, each of the coupling devices being separated from the outer surface of the shell;

a sensor adjacent the head, the sensor configured to detect vibration of the head, the sensor operatively connected to the second hoop member;

a leg support member operatively connected to the second hoop member to support at least some of the weight of the shell through the second hoop member, the leg support member for supporting the percussion instrument on a floor surface such that the head is substantially perpendicular to the floor surface, the leg support member including a stand having a fixed length and angle relative to the plane of the striking surface and at least one leg having a length extending in a longitudinal dimension in a direction from the second hoop member toward the floor surface when the leg support member supports the percussion instrument on the floor surface, the longitudinal dimension of the leg being at an oblique angle relative to the plane of the striking surface, at least one of the length and the oblique angel of the leg being adjustable.

9. The percussion instrument of claim 8, the first hoop member having an overhang portion extending from an outer peripheral portion of the first hoop member;

the second hoop member having an overhang portion extending from an outer peripheral portion of the second hoop member;

each of the plurality of coupling devices for operatively connecting the overhang portion of the first hoop member and the overhang portion of the second hoop member.

10. The percussion instrument of claim 8, each of the plurality of coupling devices comprising:

an elongated body having an interior; and at least one rod member insertable into the interior of the elongated body.

11. The percussion instrument of claim 10, the at least one rod member comprising:

a first rod member insertable through a hole in the first hoop member and into a first end of the elongated body to connect one of the plurality of coupling devices to the first hoop member; and a second rod member insertable through a hole in the second hoop member and into a second end of the elongated body to connect the one of the plurality of coupling devices to the second hoop member.

12. The percussion instrument of claim 8, the percussion instrument further comprising:

a rim sensor configured to detect vibration of the first hoop member, the rim sensor operatively connected to the second hoop member.

13. The percussion instrument of claim 12, wherein the first hoop member, the second hoop member, and the plurality of coupling devices comprise a material made of metal.

14. The percussion instrument of claim 12, the percussion instrument further comprising:

a support base for supporting the rim sensor, the support base operatively connected to the second hoop member.

15. The percussion instrument of claim 14, wherein the first hoop member, the second hoop member, the plurality of coupling devices, and the support base comprise a material made of metal.

16. The percussion instrument of claim 8, the percussion instrument further comprising:

a support member for supporting the sensor, the support member operatively connected to the second hoop member.

17. The percussion instrument of claim 8, the percussion instrument further comprising:

an attachment member attachable to an instrument stand to support the percussion instrument on a floor surface, the attachment member operatively connected to the second hoop member.

18. The percussion instrument of claim 8, wherein the percussion instrument comprises one of a tom-tom, bass drum, and snare drum.

19. A method of manufacturing a percussion instrument, the method comprising:

providing a shell having an outer surface;

arranging a head across a first end of the shell;

configuring a first hoop member to hold down the head against the shell;

arranging a second hoop member on a second end of the shell;

operatively connecting the first hoop member and the second hoop member with a plurality of coupling devices, the plurality of coupling devices configured for stretching the head, each of the coupling devices being separated from the outer surface of the shell;

arranging a sensor adjacent the head, the sensor configured to detect vibration of the head, the sensor operatively connected to the second hoop member; and operatively connecting a leg support member to the second hoop member to support at least some of the weight of the shell through the second hoop member, the leg support member for supporting the percussion instrument on a floor surface such that the head is substantially perpendicular to the floor surface, the leg support member including a stand having a fixed length and angle relative to the plane of the striking surface and at least one leg having a length extending in a longitudinal dimension in a direction from the second hoop member toward the floor surface when the leg support member supports the percussion instrument on the floor surface, the longitudinal dimension of the leg being at an oblique angle relative to the plane of the striking surface, at least one of the length and the oblique angle of the leg being adjustable.

20. The percussion instrument of claim 8, wherein each of the coupling devices is supported by and between the first hoop member and the second hoop member.

21. The percussion instrument of claim 8, wherein the shell has an outer peripheral surface and wherein each of the coupling devices is supported out of contact with the outer peripheral surface of the shell.

22. The percussion instrument of claim 8, wherein the shell has a smooth outer peripheral surface and wherein each of the coupling devices is supported at a position that is spaced apart from the smooth outer peripheral surface of the shell.

23. The percussion instrument of claim 8, wherein the shell has an outer peripheral surface, wherein each of the coupling devices has a first end coupled to the first hoop member and a second end coupled to the second hoop member, and wherein each of the coupling devices is spaced apart from the outer peripheral surface of the shell from its first end to its second end.

24. The electronic drum of claim 1, wherein the leg support member is operatively connected to the rear surface hoop for pivotal motion of the leg relative to the plane of the striking surface, to adjust the oblique angle of the leg relative to the plane of the striking surface.

25. The electronic drum of claim 1, wherein the leg support member is attached to the rear surface hoop, and supports the rear surface hoop and the cylindrical tubular member without being directly attached to the cylindrical tubular member.

26. The electronic drum of claim 1, wherein the leg support member comprises a coupling member that attaches the leg to the rear surface hoop free of the cylindrical tubular member.

27. The percussion instrument of claim 8, wherein the leg support member is operatively connected to the second hoop member for pivotal motion of the leg relative to the plane of the striking surface, to adjust the oblique angle of the leg relative to the plane of the striking surface.

28. The percussion instrument of claim 8, wherein the leg support member is attached to the second hoop member, and supports the second hoop member and the shell without being directly attached to the shell.

29. The percussion instrument of claim 8, wherein the leg support member is in contact with a section of the second hoop member and supports at least some of the weight of the shell through the section of the second hoop member in contact with the leg support member.

30. The percussion instrument of claim 8, wherein the leg support member being out of contact with the outer surface of the shell.

31. The percussion instrument of claim 8, wherein the leg support member comprises a coupling member that attaches the leg to the second hoop member free of the shell.

* * * * *